United States Patent [19]

Nishiguchi et al.

[11] Patent Number: 4,488,641

[45] Date of Patent: Dec. 18, 1984

[54] PACKING CASE OF CORRUGATED PAPER AND POSITIONING METHOD OF AN ARTICLE USING THE SAME

[75] Inventors: Takuji Nishiguchi, Osaka; Hideo Yoshimoto, Izumi, both of Japan

[73] Assignee: Sharp Kabushiki Kaisha, Osaka, Japan

[21] Appl. No.: 471,300

[22] Filed: Mar. 2, 1983

[30] Foreign Application Priority Data

Mar. 2, 1982 [JP] Japan ..... 57-29752[U]

[51] Int. Cl.[3] ..... B65D 85/64

[52] U.S. Cl. ..... 206/320; 206/44 R; 206/45.18; 206/620; 206/623; 248/174; 269/902

[58] Field of Search ..... 206/44 R, 45.13, 45.14, 206/45.18, 45.2, 320, 425, 620, 623; 248/174; 269/289, 902, 904

[56] References Cited

U.S. PATENT DOCUMENTS

| | | | |
|---|---|---|---|
| 639,054 | 12/1899 | Jenkinson | 206/45.2 |
| 2,307,571 | 1/1943 | Crandall | 206/45.2 |
| 2,547,892 | 4/1951 | Stevens | 206/449 |
| 2,564,244 | 8/1951 | Bibler | 206/45.2 |
| 2,896,837 | 7/1959 | Risucci | 206/623 |
| 2,967,610 | 1/1961 | Ebert et al. | 206/602 |
| 3,090,483 | 5/1963 | Altree et al. | 206/602 |

FOREIGN PATENT DOCUMENTS

| | | | |
|---|---|---|---|
| 0092248 | 11/1961 | Denmark | 206/45.2 |
| 2756396 | 6/1979 | Fed. Rep. of Germany | 206/320 |

*Primary Examiner*—George E. Lowrance
*Assistant Examiner*—Jimmy G. Foster
*Attorney, Agent, or Firm*—Birch, Stewart, Kolasch & Birch

[57] ABSTRACT

A packing case of corrugated paper is cut with a line around its four sides with at least two V-cut lines being provided in the opposing sides thereof. An article such as a microwave oven is fixed to a wall using a contact position between the base of the article and V-cuts of the packing case.

5 Claims, 5 Drawing Figures

PACKING CASE OF CORRUGATED PAPER AND POSITIONING METHOD OF AN ARTICLE USING THE SAME

BACKGROUND OF THE INVENTION

The present invention relates to a packing case and, more particularly, to a carton packing case of corrugated paper for packing an article which is to be hung on a wall.

In some cases, heavy articles such as microwave ovens should be hung on walls. When such articles are hung on by fixing their backs to the walls without providing a base support, it becomes difficult to adequately secure them to the walls. Also, since kitchens contain many articles including a sink, a gas-range, a wall cupboard and the like, it becomes increasingly more difficult to find sufficient wall support for the articles.

Therefore, there is always the present danger that the heavy article may fall, or cause damage to the remaining kitchen articles when the article is being hung.

SUMMARY OF THE INVENTION

Accordingly, it is an object of the present invention to provide an improved packing case for assisting in hanging an article on a wall.

It is another object of the present invention to provide an improved packing case of corrugated paper for packing an article and for being capable of assisting in hanging the article on a wall.

It is a further object of the present invention to provide an improved method of positioning an article using a packing case of corrugated paper.

Briefly described, in accordance with the present invention, a packing case of corrugated paper for packing an article is cut along its four sides in which at least two V-cuts are symmetrically formed in at least two opposing sides thereof.

The article is positioned against a rear wall by rotating the article around a contact point between the article and the V-cuts of the packing case.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE INVENTION

The packing case of corrugated paper of the present invention can containg any article, in particular, heavy one. The present invention is described herein with reference to a packing case used for a microwave oven to be hung on a wall. However, this example is not intended to limit that the packing case of the present invention to one which can only be used in connection with a microwave oven.

Figure 1:
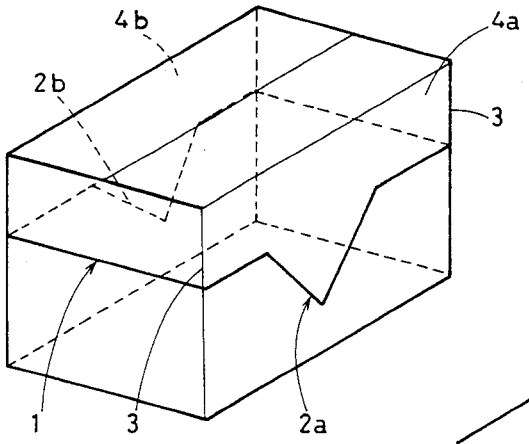
FIG. 1 shows a perspective view of a packing case of corrugated paper according to the present invention.

FIG. 1 shows a perspective view of the packing case of corrugated paper of the present invention. It is assumed that the packing case contains a microwave oven of about 30–40 Kg to be hunged on a wall. The microwave oven forms a part of a system kitchen.

The packing case of the present invention is featured in that it is cut with a cut line 1 around its four sides with two opposing V-cuts.

In the longitudinal side 4*a* of the packing case, a first V-cut 2*a* is formed. In the opposing longitudinal side 4*b*, a second V-cut 2*b* is formed.

In the side 4*a* containing the first V-cut 2*a*, two corners are cut by each of lines 3 starting from the cut line 1 and ending with the top.

All the lines are formed as chain lines which fasten the carton so that it does not open when exposed to stress during travelling.

Figure 2:
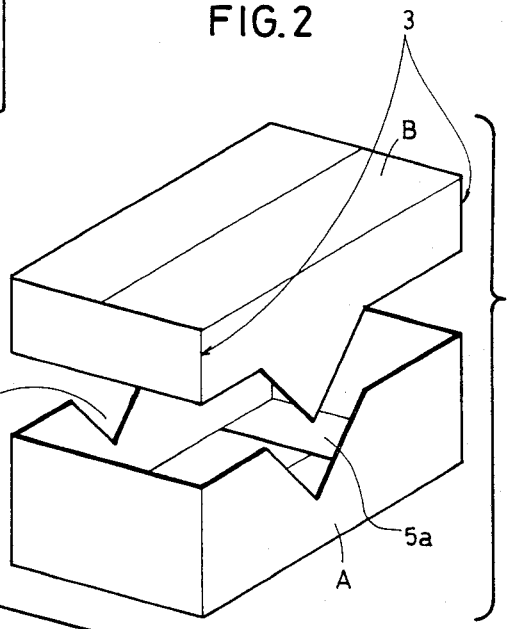
FIGS. 2 and 3 show perspective views of the packing case of FIG. 1 in which the packing case is opened along its cut lines.
Figure 3:
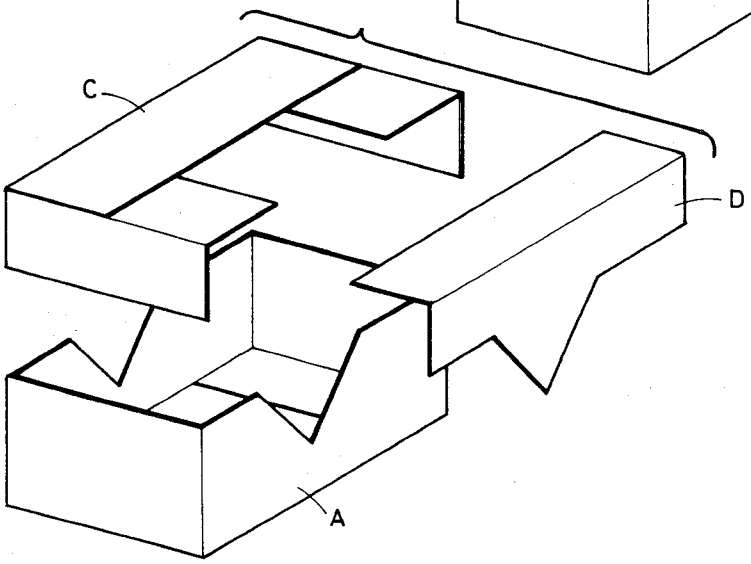

FIGS. 2 and 3 show perspective views of the open package of FIG. 1.

A knive can be used to open the package along the cut line 1 around its sides. The lower portion of the carton case A and the upper portion of the carton case B are separated as shown in FIG. 2. The first carton case A has V-cuts 5*a* and 5*b* in its longitudinal sides.

As FIG. 3 shows, the upper portion of the carton case B further separated into carton sheets C and D along the boundary lines disposed therebetween.

Figure 4:
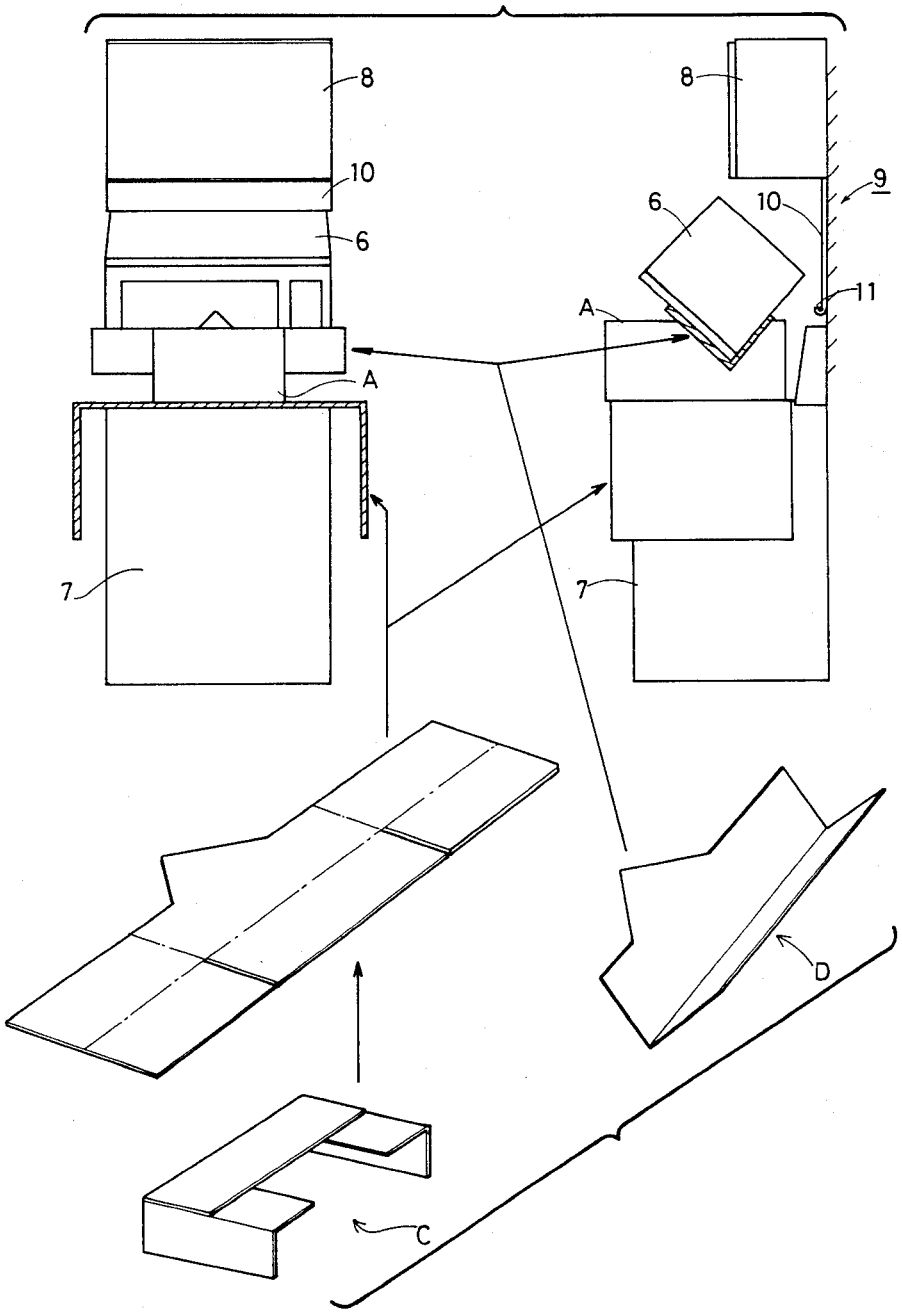
FIG. 4 shows views of an article and the packing case of FIG. 1 representing the hanging operation using parts of the packing case of FIG. 1.

FIG. 4 shows views of the packing case and the microwave oven representing the hanging operation using parts of the packing case.

The microwave oven is denoted as 6 which is to be hung on a wall 9 surrounded by a gas range 7 and a wall cupboard 8.

First, the carton sheet C is placed on the gas range 7. On the carton sheet C, the carton case A is disposed and then the folded sheet D is fitted into the V-cuts 5*a* and 5*b* to provide a lateral support across the box A. The front and lower edges of the microwave oven 6 are then fitted on the reversed carton sheet D. The microwave oven 6 is protected by the reversed carton sheet D form being damaged, directly, by the V-cuts 5*a* and 5*b*.

On the wall 9, a fixing plate 10 is provided for hanging the microwave oven 6 by combining a lower projection 11 of the fixing plate 10 with a hanging element part 12 of the microwave oven 6.

Figure 5:
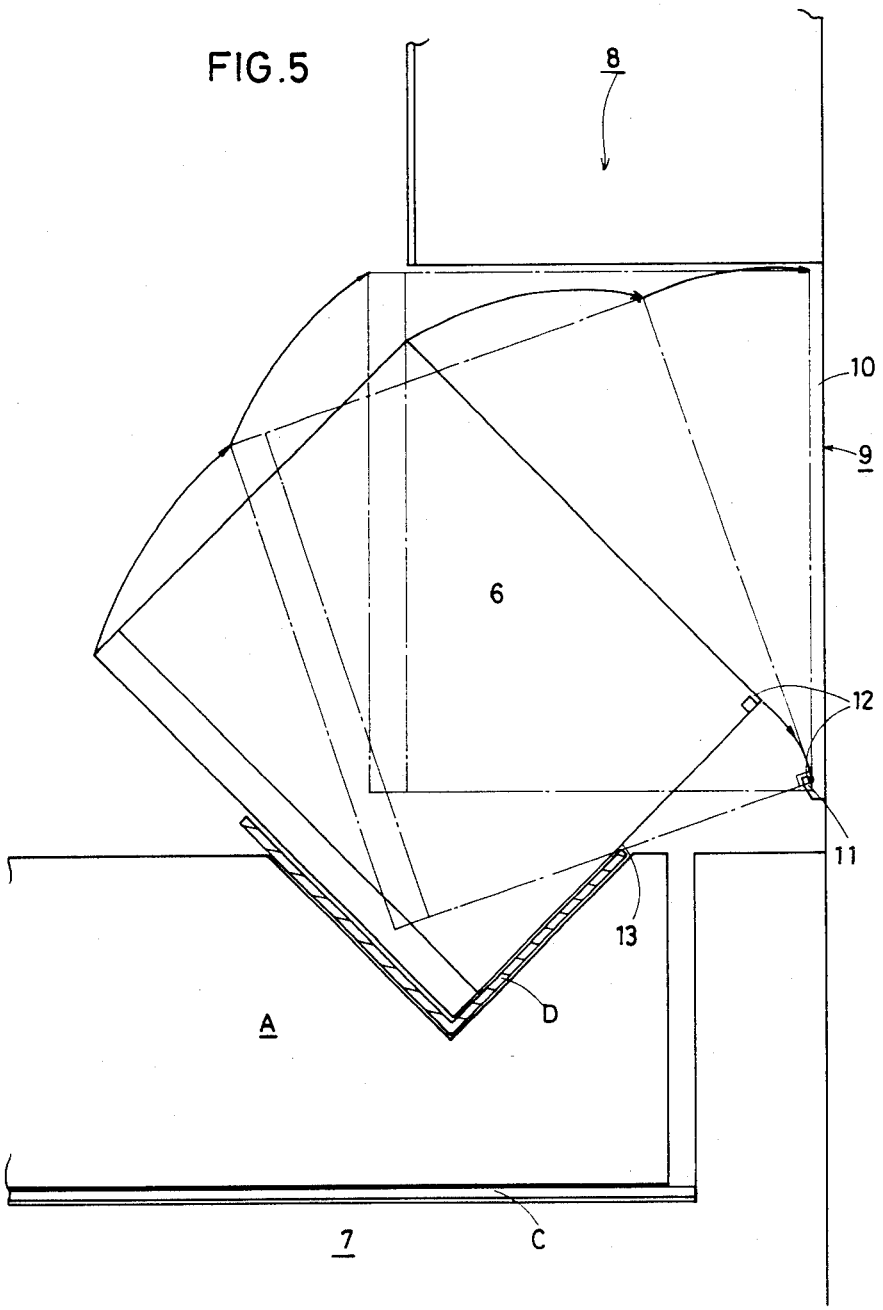
FIG. 5 shows a side view of the article and the parts of the packing case of the present invention.

FIG. 5 shows a side view of the microwave oven 6 and the thus-constructed packing case.

Before the microwave oven 6 is fixed on the wall 9, the microwave oven 6 disposed on the carton case A of the carton sheet C is slid to confront the lower projection 11 while the microwave oven 6 is carried on the carton case A via the carton sheet D.

After a rough alignment is performed using eye-measurement, the microwave oven 6 is rotated around a supporting point 13 of the base center of the microwave oven 6, the base center being in contact with the edges of the carton sheet D. Thus, the hanging element 12 of the microwave oven 6 engages the lower projection 11 of the fixing plate 10 thereby joining them together.

Thus, the back of the microwave oven 6 confronts the fixing plate 10 with the hanging element 12 being joined with the lower projection 11. Then, the front part of the microwave oven 6 is placed in an upright position. Other necessary joints are provided to fix the microwave oven 6 on the wall 9.

If the eye-measurement for aligning the microwave oven 6 with the fixing plate 10 is inaccurate the carton case A supporting the microwave oven 6 can be further slid to adjust the mounting position. Since it is unnecessary to directly support the heavy microwave oven 6, less problems are encountered.

The number of cut lines 1 are not limited to one. It may be useful to cut the carton packing case with cut lines having different heights.

Further, the carton sheet D is disposed on the V-cuts 5*a* and 5*b* to withstand the weight of the microwave oven 6 and to protect the microwave oven 6 from the edges of the V-cuts 5*a* and 5*b*. It may be possible that the carton sheet D is not disposed on the V-cuts 5*a* and 5*b* if the carton case A can withstand the weight of the microwave oven 6 by itself and when the microwave oven 6 is not damaged by the edges of the V-cuts 5*a* and 5*b*.

While only certain embodiments of the present invention have been described, it will be apparent to those skilled in the art that various changes and modifications may be made therein without departing from the spirit and scope the present invention as claimed.

What is claimed is:

1. A packing case for housing a device, said packing case containing fold lines and being separated along a cut line which extends along the four sides thereof into an upper portion and a lower portion, said cut line forming opposing V-shaped slots in at least two opposing sides of said lower portion, said upper portion being further separated into a first portion and a second portion, said second portion being folded along its fold line into a V-shaped surface which is disposed across the packing case in complimentary position to the V-shaped slots in the bottom portion thereby providing a transverse support surface across the packing case for receiving the edge portion of the device and supporting said device to facilitate mounting of the device to a wall.

2. A packing case for housing a device, said packing case being adapted to be converted into a support to facilitate the mounting of the device onto a wall which comprises a cut line formed along the four sides of the packing case dividing the packing case into an upper and lower portion, said cut line containing at least two opposing V-shaped portions which form V-shaped slots in the lower portion when the upper and lower portions are separated along said cut lines and the upper portion of said packing case being further separable along a cut line into a first portion and a second portion, said first portion and second portion also containing respective fold lines, whereby said first portion functions to support the lower portion of the packing case and said second portion, folded along its fold line forms a V-shaped surface which is complimentary to said V-shaped slots in the bottom portion and is adapted to provide a transverse support surface across the packing case for receiving the edge of the device and supporting the device to be mounted to the wall.

3. The packing case of claim 2, wherein the packing case is made of corrugated paper.

4. A method for positioning a device for mounting on a wall which comprises providing a packing case which contains a cut line and fold lines, said cut line extending along the four sides of the packing case, dividing and separating the packing case along said cut line into an upper and lower portion, said cut line containing at least two opposing V-shaped portions which form V-shaped slots in the lower portion, separating the upper portion into a first and second portion, folding the second portion along its fold line to form a V-shaped surface, placing the folded V-shaped surface in said V-shaped slots whereby said V-shaped surface extends across the packing case, placing the edge of the device to be mounted in said V-shaped surface, and rotating the device around a contact edge between the edges of the V-shaped surface and a part of the device until the rear surface of the device is placed into engaging contact with the wall.

5. The method of claim 4, wherein the device is a microwave oven.

* * * * *